US005288128A

United States Patent [19]

Smith et al.

[11] Patent Number: 5,288,128

[45] Date of Patent: Feb. 22, 1994

[54] RECLINING THEATER SEATING

[75] Inventors: Kenneth E. Smith, Saco; David L. Sutter, Kennebunkport, both of Me.

[73] Assignee: Hussey Seating Company, North Berwick, Me.

[21] Appl. No.: 873,474

[22] Filed: Apr. 24, 1992

[51] Int. Cl.[5] ..... A47C 1/121

[52] U.S. Cl. ..... 297/332; 297/331; 297/248

[58] Field of Search ..... 297/331, 332, 325, 326, 297/327, 248, 300, 301

[56] References Cited

U.S. PATENT DOCUMENTS

| | | | |
|---|---|---|---|
| 2,595,582 | 5/1952 | Hoven et al. | 297/301 |
| 2,719,570 | 10/1955 | Hoven et al. | 297/332 |
| 3,098,677 | 7/1963 | Williams | 297/332 X |
| 3,287,060 | 11/1966 | Thompson | 297/332 |
| 3,589,762 | 6/1971 | Henrikson | 297/331 X |
| 3,744,843 | 7/1973 | Bavecki et al. | 297/332 X |

*Primary Examiner*—James R. Brittain
*Assistant Examiner*—Milton Nelson, Jr.
*Attorney, Agent, or Firm*—Pandiscio & Pandiscio

[57] ABSTRACT

A reclining chair suitable for use in theaters or the like is provided wherein the backrest and seat are mounted upon spaced-apart wings having a substantially inverted, truncated, right triangular shape. The wings are respectively pivotally mounted to the inner sides of a pair of spaced-apart stanchions such that in the upright position of the chair the axis upon which the seat is mounted to the wings is located close to and substantially directly vertically above the axis upon which the wings are pivotally mounted to the respective stanchions. Stops are provided on the stanchions which interact with stop engaging surfaces on the wings to limit the forward and the downward and rearward travel of the backrest and seat. The attachment of the wings to the stanchions also is spring loaded in a manner which assures the return of the backrest and seat to their upright position when the chair is unoccupied and provides maximum spring resistance to the rotation of the wing about its pivotal attachment to the wing upon an individual occupying the chair and leaning back against the backrest. The chair thereby avoids the tendency of prior chairs to move backwardly and downwardly immediately upon being occupied by the provision of a simple, safe and easily repaired structure.

28 Claims, 5 Drawing Sheets

RECLINING THEATER SEATING

BACKGROUND

1. Field of Invention

The present invention relates generally to theater seating. More particularly, the invention relates to a theater chair designed to assume a reclined position when occupied and to automatically assume and maintain an upright position when unoccupied.

2. Summary of the Prior Art

Theater chairs designed to permit an occupant to assume a reclined position upon occupying a seat wherein the reclining mechanism automatically returns the seat to its upright position and maintains that position when the chair is unoccupied are well known in the art. Unfortunately, however, such chairs heretofore have not been entirely satisfactory in terms of their durability, noise, ease of repair or comfort and safety to the occupant and those around him. The reasons for this vary from one design to another. In general, however, the frequent breakage of component parts of the reclining mechanism, the necessity of disassembly of adjacent chairs in order to gain access to and to repair damage or replace broken parts of a particular chair, and problems associated with the use of the chair by theatergoers are the most prevalent problems. Particular among the problems associated with chair usage are excessive noise, jamming of the reclining mechanism, and the danger of the chair occupant or those around him being injured. Heretofore such injuries have been caused, for example, by the entrapment of clothes, fingers, hands or feet in the reclining mechanism, or by the movement of the seat portion of the chair either in the course of its normal operation or as a result of the failure of a component part thereof.

Additional problems are presented for many individuals in arising from such prior chairs. This is because in conventional chairs of this type the seat portion shifts significantly towards the floor as the chair reclines. Hence, the occupant finds himself sitting below standard chair height, often in a position with his hips located below his knees. In order to arise from the chair, therefore, the occupant must pull himself upwardly and forwardly until his center of gravity is located substantially above his feet. This can be stressful and a great inconvenience, particularly to heavy or elderly theatergoers. Indeed, in some cases the only way such an individual can arise from these prior chairs is to twist himself sideways to the chair in order to thereby shift the location of his hips relative to his feet sufficiently to allow him to arise. The nature of these problems will be better understood with reference to the following summary of various of the reclining theater chairs of the prior art.

Typically, theater chairs include a pair of fixed, armrest supporting uprights and a seating unit mounted therebetween. The chairs generally are arranged in rows such that each seat shares at least one upright with the chair(s) adjacent thereto. The back and seat portions of the seating unit are attached to side support members, the back at a predetermined angle to the vertical and the seat substantially parallel to the horizontal. Also, if desired, the seat may include manual or spring means for pivoting the seat to a position generally parallel to the vertical when it is not in use. The side support members in turn are connected to the uprights and/or to reclining mechanisms which control the movement of the support members relative to the uprights. These reclining mechanisms have included (1) coil springs fixedly located within housings formed by the uprights having the support members attached to their inner ends; (2) leaf springs extending between the forward edges of the seat supports (or the forward edge of the seat portion) and the floor; (3) pivotally attaching the forward ends of the support members directly to the uprights and biasing the seat unit toward an upright position with either springs attached to the rear of the seating unit, or a torsion bar running between the points of pivotal attachment as shown in U.S. Pat. No. 3,567,281; and (4) a leaf spring formed of a composite material affixed at its forward and rear ends to the support and also connected adjacent its forward end to the upper end of a downwardly curved rocker plate attached to the adjacent upright. These reclining mechanisms are variously present in the art both with and without means for limiting the travel of the seat.

Each of these spring biasing means maintains the seat portion of the chair in its upright position in the absence of an occupant sitting in the chair. The geometry of these prior chair structures, however, is such that as soon as a prospective occupant sits upon the seat cushion, the seat portion of the chair tends to shift toward the floor and to tilt backward. Depending upon the strength of the biasing spring, this downward and backward movement may be quite fast thereby causing damage to the reclining mechanism and/or injury not only to the chair occupant, but also to an individual seated behind the chair. Similarly, in the event that the biasing spring and/or seat travel limiting means breaks or becomes dislodged, many of these chairs have no means for preventing the chair from flipping backwardly with consequent possible injury not only to the occupant, but also to those around him.

BRIEF DESCRIPTION OF THE INVENTION

Accordingly, it is an object of the invention to provide a reclining theater chair which is comfortable and easily used, yet safe for an occupant and those around him.

It is also an object of the present invention to provide a reclining theater chair which is easily assembled and repaired in the field without the need for disassembly of adjacent chairs, specialized tools or detailed training.

Further, it is an object of the present invention to provide a reclining theater chair which is aesthetically pleasing in appearance and quiet in operation.

Still further, it is an object of the present invention to provide a reclining theater chair which is strong, durable and comparatively inexpensive.

These and other objects of the invention are accomplished by the provision of a reclining theater chair including a pair of spaced-apart stanchions, and a seat assembly including a backrest, a seat and a pair of spaced apart mounting wings.

Specifically, each of the stanchions defines a substantially vertical support having an inner side facing the other of the stanchions. Each of the stanchions also includes stop means projecting inwardly from its inner side.

The mounting wings are each substantially flat elements including first and second stop receiving means, and having a substantially inverted, truncated, right triangular shape defined by an upper edge, a lower edge, a first side edge extending substantially normally between the upper and lower edges, and a second side edge extending at an angle between the upper and lower edges. The mounting wings are pivotally attached in spring loaded relation to the inner sides of the stanchions at corresponding first points on the wings located adjacent the corner formed by the lower edge and the first side edge and a preselected distance normally of the first side edge. This pivotal attachment is such that each wing is rotatable relative to the stanchion to which it is attached between (1) a first position wherein the stop means engages the first stop receiving means and the first side of the wing is disposed substantially vertically, and (2) a second position wherein the stop means engages the second stop receiving means and the first edge of the wing is tilted at an angle to the vertical. The backrest is supported substantially between the second side edges of the respective wings, and the seat is supported on an axis extending substantially between corresponding second points on the wings located immediately above the corresponding first points a normal distance from the first side of the wings substantially equal to the preselected distance of the first points therefrom.

These elements co-operate in such a way that in the normal process of sitting in the chair an individual will first realize a normal upright sitting position. Thereafter, as the individual leans back against the backrest thereby shifting his center of gravity rearwardly, the seat assembly will move to its reclined position with a minimum shift of the juncture of the seat and the backrest toward the floor.

In a preferred embodiment, the stanchions are generally rectangular uprights including rearwardly extending projections adjacent their upper ends. These projections along with the upper ends of the uprights define armrest supporting surfaces. Further, the stop means includes at least one post extending inwardly from the inner side of each stanchion adapted to engage a slightly downwardly angled slot in the wing attached thereto, the slot extending from a point adjacent the first side of the wing generally across the wing toward its second side. Two additional posts extend inwardly from the inner side of the stanchion in spaced relation to each other in a plane immediately below and parallel to the armrest supporting surface. These posts are designed to engage a specially contoured upper edge of the wing to restrain the forward rotation thereof while not impeding its rearward rotation.

Also, a flange extends inwardly from each wing between its first side edge and its second side edge substantially immediately above the attachment of the wing to the stanchion. This flange is substantially parallel to the truncated side of the wing in the area directly above the pivotal attachment of the wing to the stanchion and angled downwardly thereafter as it extends rearwardly across the inner face of the wing. A compression spring extends normally from the outer portion of the angled section of the flange to a post extending inwardly from the lower portion of the stanchion adjacent the truncated side of the wing.

The seat includes spring loaded fittings on its left and right sides which are attached to the portions of the flanges which are parallel to the truncated edges of the wings such that the axis of rotation of the wings on the stanchions is located in substantially the same vertical plane as the axis of rotation of the seat on its fittings when the seat assembly i in its upright position. The spring loaded fittings allow the seat to move between an open position for use and a closed, generally vertical, position.

It will be understood, therefore, that the geometrical relationship of the components of the present chair is such that an individual may sit in the chair in an upright position without the seat assembly falling downwardly and backwardly away from him. When the individual leans back against the backrest of the chair, the seat assembly shifts backwardly in a manner similar to prior chairs, but shifts downwardly only slightly. Specifically, the axis supporting the seat shifts to a location which is a short distance below and to the rear of its location when the chair is in the upright position, and also is above the axis of pivotal attachment of the mounting wings to the stanchions. Accordingly, the seat assembly will not "fall away" from an individual as he sits down in the chair. Further, it is much easier for an occupant to arise from the present chair than from the chairs of the prior art.

It additionally will be understood that the posts adjacent the armrest provide a fixed forward travel stop adapted to prevent the chair from moving too far forward when unoccupied, in use, or when an occupant is arising from the chair. Further, it will be understood that the post and slot configuration provides a fixed rearward travel stop adapted to prevent the chair from moving too far in the reclined direction. Still further, it will be understood that should the springs break or become disengaged and/or the post and slot engagement fail, the post utilized for mounting the bottom end of the spring is also a failsafe stop. That post will engage the adjacent lower edge of the mounting wing in the event of such a failure and thereby prevent the seat assembly and chair back from falling backwards without restraint with resultant possible injury to the occupant or those around him.

Appropriate mechanism covers are provided which are attached to the inner ends of the posts. These covers may be adapted for an aisle end or to face the occupant of the chair. Additionally, all openings in the reclining mechanism are covered to prevent inadvertent injury. Further, the mechanism will, to the extent possible, be made quiet and smooth in operation.

BRIEF DESCRIPTION OF THE DRAWINGS

These and other features and advantages of this invention will become apparent to those skilled in the art in view of the following detailed description of a preferred embodiment of the invention taken together with the appended drawings in which.

DETAILED DESCRIPTION OF PREFERRED EMBODIMENT

Figure 2:
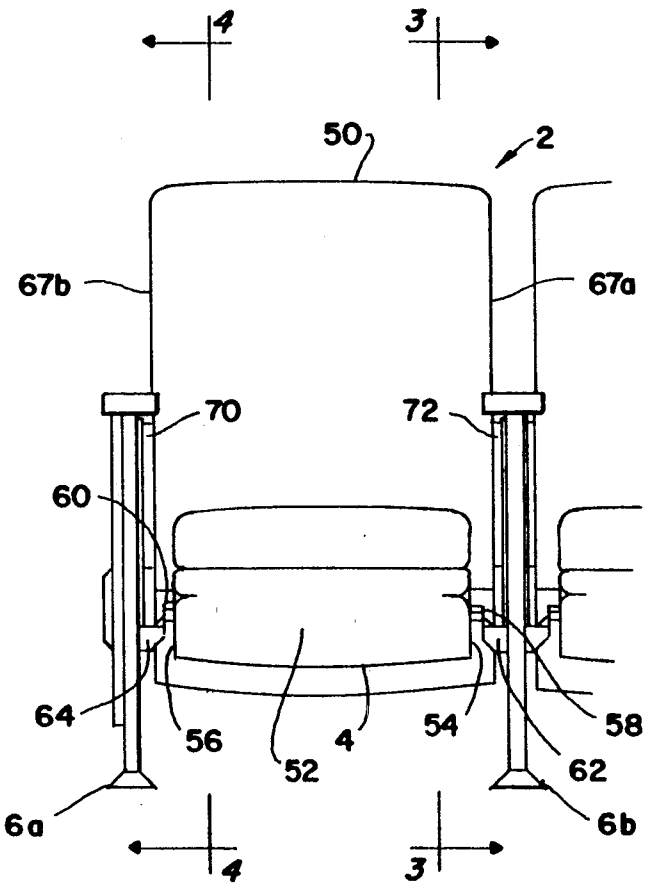
FIG. 2 a fragmented representative front elevational view of a row of chairs in accordance with the invention showing the chair adjacent the aisle and a portion of the chair next adjacent thereto.
Figure 1:
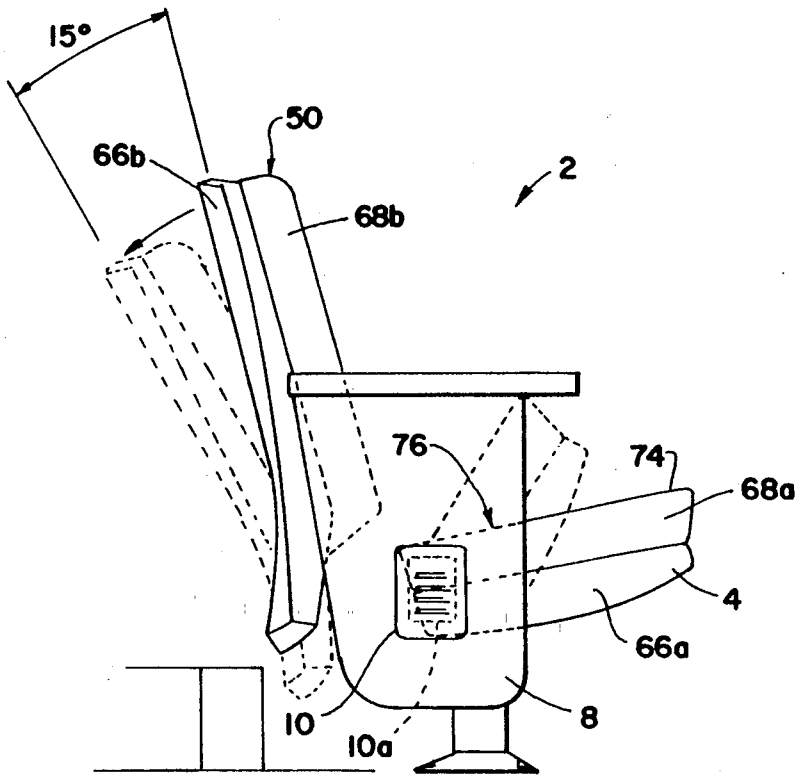
FIG. 1 is a side elevational view of a reclining theater chair in accordance with this invention and suitable for use on an aisle wherein the seat portion of the chair is shown in its upright position in solid lines and in its reclined position in dotted lines.

Referring now to the drawings, and particularly to FIGS. 1 and 2, a reclining theater chair in accordance with the invention is shown generally at 2. The chair 2 is of the type which is commonly utilized in theaters in rows wherein a seat assembly, generally indicated at 4, is mounted between adjacent pairs of spaced apart, generally vertical stanchions 6*a* and 6*b*. It will be understood, therefore, that the stanchions may at one and the same time serve as the left hand support for one chair and the right hand support of the adjacent chair. Stanchions applied in this manner are termed "center stanchions" and include a plurality of component parts, two sets each. Each such set is associated with either the left or the right side of the stanchion and is capable of performing its functions independently of the other set of parts. (see stanchion 6*b*)

Figure 6:
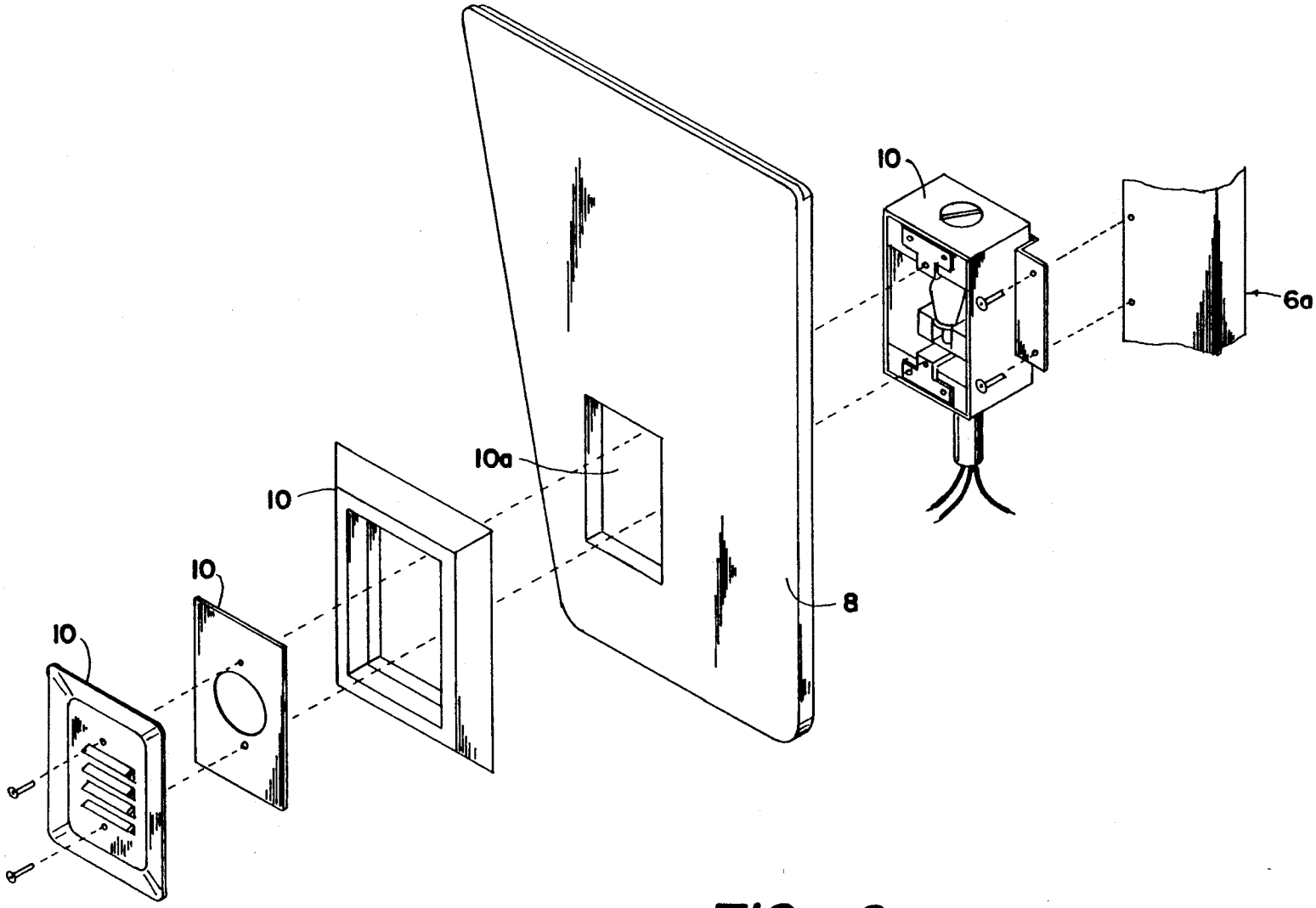

Aisle end stanchions may be located at the left or right aisle end of a row (see stanchion 6*a*), without departure from the present invention. In the latter case, the stanchion 6*a* will be provided with an outer cover 8 (best seen in FIG. 4) to avoid the chance of catching or snagging the clothes, fingers or the like of theatergoers in the mechanism and to preserve the aesthetically pleasing appearance of the theater. Also, an aisle illumination means 10 may be provided which is adapted to shine through an aperture 10*a* in the outer cover 8 to assure the safety of theatergoers in moving about the otherwise darkened theater during a performance. (see FIG. 6)

Figure 3:
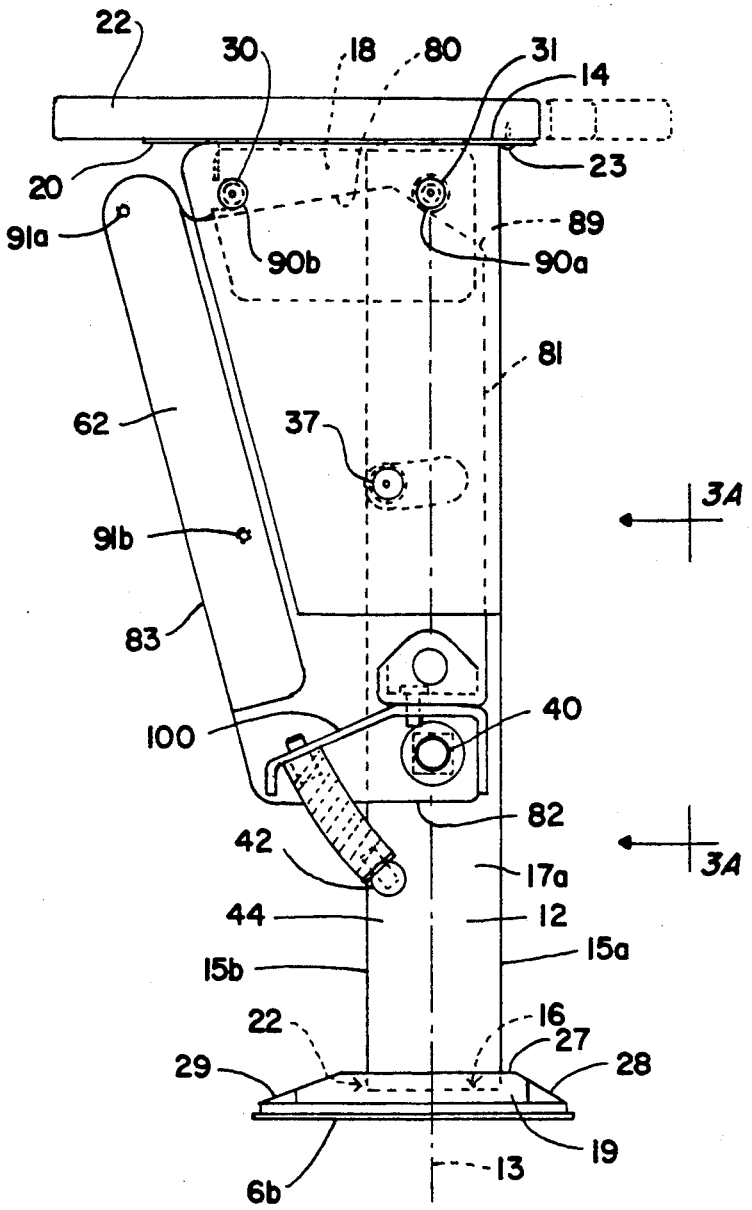
FIG. 3 is a side view of a reclining mechanism for theater chairs in accordance with the present inventions taken along the line 3—3 of FIG. 2.
Figure 3A:
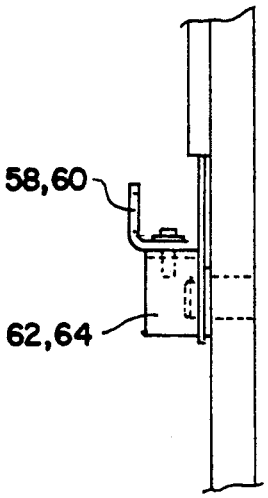
FIG. 3A is a side view of the portion of the reclining mechanism designated by the line 3A—3A in FIG. 3 and rotated 90° clockwise about the vertical axis of the upright shown in FIG. 3 wherein the spring has been deleted for clarity.
Figures 4, 4A:
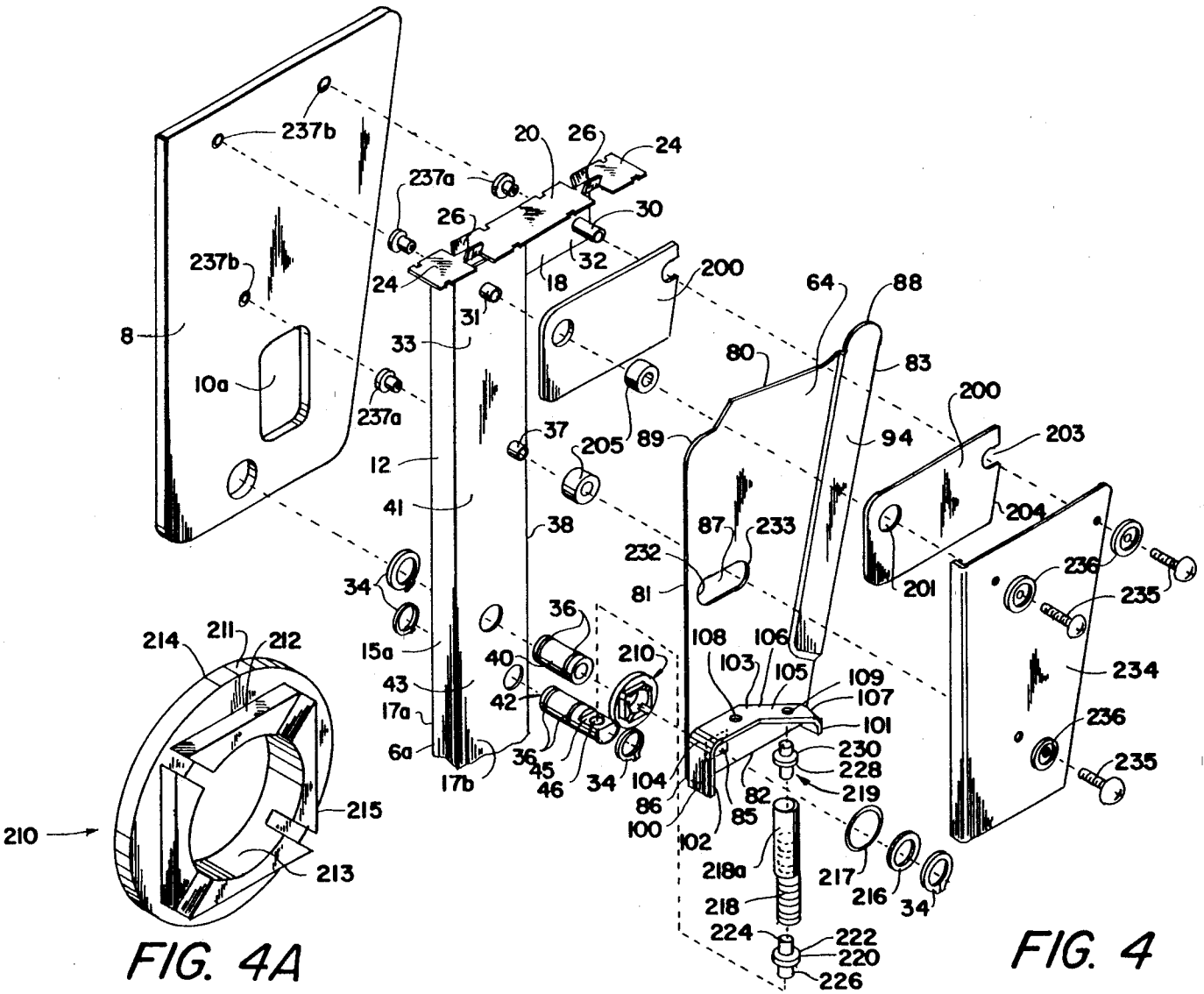
FIG. 4 is an exploded isometric view of an aisle end stanchion assembly in accordance with the invention.
FIG. 4A is a perspective view of the bushing 210 shown in FIG. 4.
Figure 5:
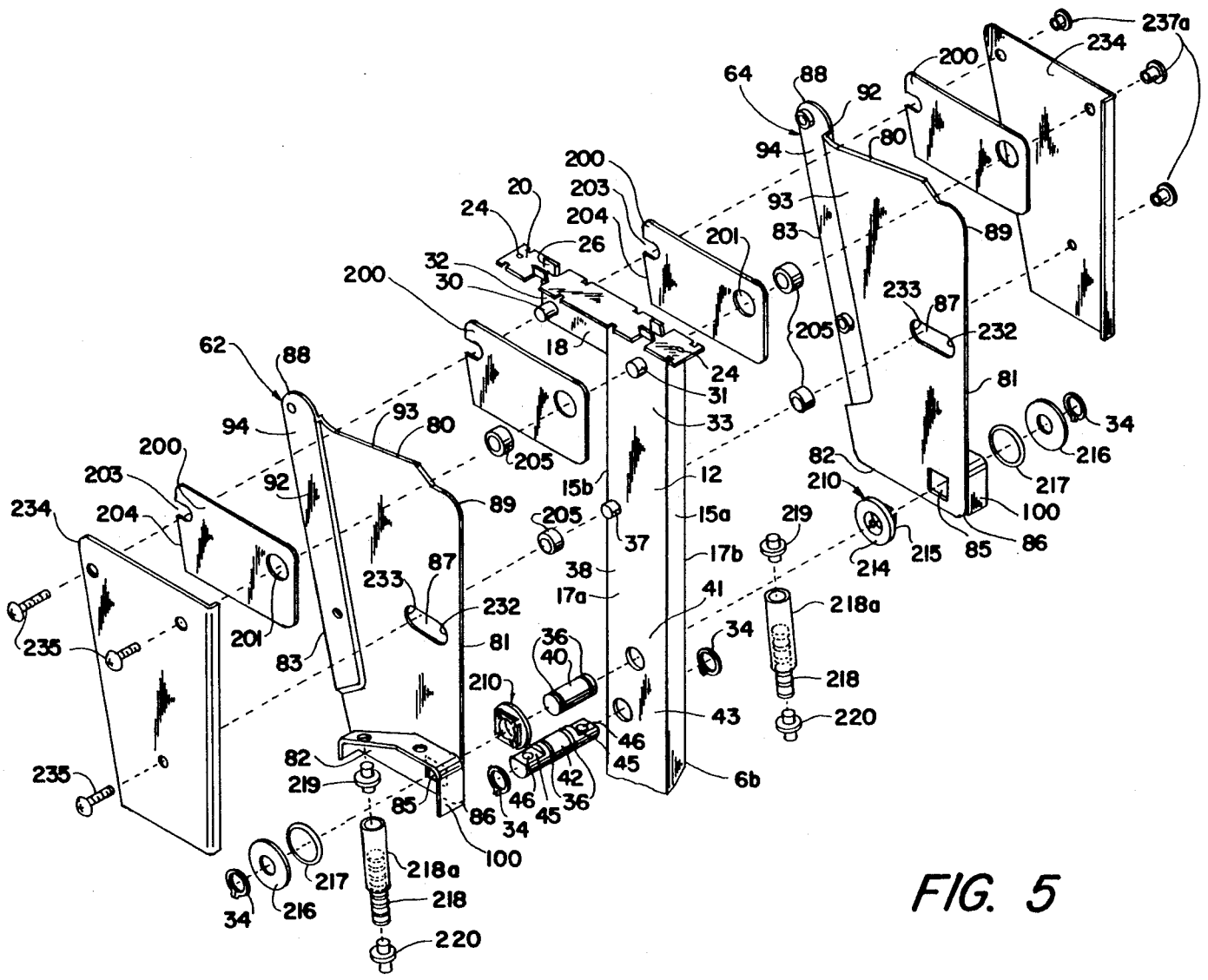
FIG. 5 an exploded isometric view of the assembly of a center stanchion (i.e., a stanchion common to two chairs in accordance with the invention; and, FIG. 6 is an exploded isometric view of an aisle end cover assembly including an aisle illumination means in accordance with the present invention.

Each of the stanchions 6*a* and 6*b*, best seen in FIGS. 3, 4 and 5 are identical. Each includes a vertical, substantially rectangular upright 12 having a vertical axis 13, an upper end 14, a lower end 16, front and rear narrow sides 15*a* and 15*b* and left and right broad sides 17*a* and 17*b*; a foot portion 19 affixed to the lower end 16 of the upright 12 and a projecting portion 18 extending normally in a substantially vertical plane from the center of the rear side 15*b* adjacent to the upper end 14 of the upright 12. The upper end 14 of the upright 12 and the projecting portion 18 together support a substantially horizontal upper surface 20 to which an armrest 22 of a conventional type may be affixed. This may be accomplished, for example, by screws 23 extending through holes 24 in the surface 20 and thence into the armrest (or a portion thereof), and by engagement of the armrest with flanges 26 extending upwardly from the surface 20, as shown in FIGS. 4 and 5.

Hollow posts 30 and 31, respectively, extend inwardly and normally from the rear section 32 of projecting portion 18 and from the upper portion 33 of at least one of the broad sides of upright 12 in a plane substantially parallel to the upper surface 20. As shown in FIGS. 4 and 5, posts 30 and 31 extend inwardly from the broad sides 17*a* and 17*b* of the stanchion 6*b* equally, while corresponding posts extend inwardly from only the inner side 17*b* of stanchion 6*a*. This is because a seating unit is to be mounted only adjacent to the side 17*b* of stanchion 6*a*, while a seating unit is to be mounted adjacent to both sides 17*a* and 17*b* of stanchion 6*b*. Henceforth in this description for clarity of presentation it is to be understood that corresponding elements of the reclining mechanism are to be found on, or adjacent to, each side of a stanchion adjacent to which a seating unit is to be located unless otherwise indicated.

Posts 30 and 31 conveniently may be formed from sections of rigid steel tubing extending through bores in the stanchions 6*a* and 6*b*. In the embodiment shown, the locations of these tubing sections is maintained by tack welding the circumference of the tubing located within the bores to the adjacent stanchion. In addition, hollow post 37 extends normally through, and is secured to, the stanchion at a point adjacent the rear edge 38 of the broad sides 17*a* and 17*b* at the lower end of the upper portion 33 of the upright 12, and is similarly welded in place. Further, a hollow post 40 extends normally from a centrally located point in the middle portion 41 of the broad side walls 17*a* and 17*b*. Still further, a solid post 42 extends normally through the stanchion at a point adjacent the rear edge 38 of the broad sides 17*a* and 17*b* at the upper end 43 of the lower portion 44 of the upright 12. The solid post 42 includes at least one flattened section 45 and a bore 46 extending normally into the flattened section 45. Posts 40 and 42 extend through the upright 12 and are secured on either side thereof by external retaining rings or spring clamps, representatively indicated at 34, engaging grooves 36 in the outer surface of these elements. The latter form of attachment facilitates the repair or replacement of the reclining mechanism or components thereof without the need for special tools.

The foot portion 19 provides a broad supporting base for the post 12 which may or may not be affixed to the floor depending upon the application. As best seen in FIG. 3, the foot 19 contains a slot 22 in its upper surface 27 adapted to receive lower end 16 of upright 12 in secure relationship thereto foot 19 also includes portions 28 and 29 which extend respectively forwardly and rearwardly of walls 15*a* and 15*b* of the upright 12 portions 28 and 29 may be adapted to receive screws or bolts (not shown) therethrough for mounting purposes.

As alluded to above, the stanchions 6*a* and 6*b* are generally arrayed in spaced rows and in spaced relationship to each other with the broad sides 17*a* and 17*b* disposed transverse to the length of the rows so as to form the basic seating configuration of a theater (see FIG. 2). The preferred material for the stanchions and feet is metal, preferably steel or cast iron. Further while the upright 12, and feet 19 may be solid, it has been found that adequate strength may be achieved if these elements are hollow. In the preferred embodiment herein shown, it has been found that the following stanchion dimensions are satisfactory:

| | |
|---|---|
| Height of upright 12 | 12 to 23.25 inches |
| Outer cross-section of upright 12 | 1 inch × 3 inches |
| Material of upright 12 | 16 gage steel |
| Material of projection 18 | 14 gage steel |
| Dimensions of projection 18 | $1\frac{1}{8}$" × $3\frac{1}{8}$" |
| Posts 30, 31 and 37 | 0.5" O.D.<br>0.350 I.D.<br>1.380" or 1.750" long |
| Post 40 | 0.752" O.D.<br>0.70 I.D. |

-continued

| | |
|---|---|
| | 1.875" or 2.30" long |
| Post 42 | 0.75" O.D. 2.438" or 3.50" long 1" long flat portion 0.386 bore diameter |

It will be understood that the length of the posts varies according to whether they are used with an end stanchion or a center stanchion; that the flat portions 45 of post 42 are to be located in the same plane and adjacent the ends of the post which project substantially beyond the broad sides of the stanchion; and that the material of each of the posts is metal, preferably steel.

The seating assembly 4 includes a backrest 50, a seat portion 52 having a left side 54 and a right side 56, left and right spring loaded seat portion mounts 58 and 60 respectively, and left and right mounting wings 62 and 64. As will be seen from the drawings, the backrest 50 and the seat portion 52 are of conventional construction. Each respectively includes a pan portion, 66*a* and 66*b*, supporting a cushion portion, 68*a* and 68*b*. The backrest 50 may also include a pair of opposing, parallel, generally rectangular, mounting flanges 70 and 72 located along the left and right sides 67*a* and 67*b* of the backrest respectively. The seat portion includes a forward, thigh supporting section 74 and a rear, hip supporting section 76. The left and right seat portion mounts 58 and 60 are attached to the left and right sides 54 and 56 of the pan 66*a* of the seat portion 52 respectively such that the seat may rotate thereabout upon a horizontal axis located substantially directly below the hip support section 76. Mounts 58 and 60 also act to urge the seat portion 52 to its closed, generally vertical, position (shown in dotted lines in FIG. 1) when the chair is unoccupied.

Mounting wings 62 and 64 are substantially flat elements formed of 14 gage steel having a substantially inverted, truncated, right triangular shape including a upper side 80, a forward side 81, a lower side 82 and a rear, angled side 83. A square hole 85 extends normally through each wing adjacent the corner 86 formed by the lower side 82 and the forward side 81. In a preferred case, upper side 80 has a horizontal length of 8.70 inches, lower side 82 has a horizontal length of 5.25 inches, forward side 81 has a vertical length of 13.88 inches, and hole 85 is a 1 inch square. The center of hole 85 is located 1.25" from forward side 81 and 1.00" from lower side 82. Further, a slot 87 extends normally through the wing from a point adjacent the forward side 81 and approximately 6.00" from the center of square hole 85 at a slight downward angle to the horizontal (in the preferred embodiment shown about 3°) generally toward the rear side 83. In the preferred case, slot 87 is about 1.75 inches long and 1 inch wide.

Still further, the upper side 80 forms a continuous contour (best seen in FIG. 3) which curves fairly sharply downwardly, then gradually upwardly and finally fairly sharply downwardly again as it extends from the rounded corner 88 formed by the upper side 80 and the rear angled side 83 to the rounded corner 89 formed by the upper side 80 and the forward side 81. Each of the sharply downwardly curved portions of this contour forms a generally forwardly facing bearing surface shown at 90*a* and 90*b*, respectively. Holes 91*a* and 91*b* are provided adjacent to the rear, angled side 83 as shown. Hole 91*b* is set further from rear, angled side 83 than is hole 91*a* such that a line passing through the center of both hole 91*a* and hole 91*b* forms an angle of about 21° to the vertical, forward side 81. Each of the mounting wings, 62 and 64, also has an inner face 92 and an outer face 93. It will be understood that these faces will be reversed in the case of the right wing as compared to the left wing (see FIG. 5). The upper portion 94 of the angled side 83 of each wing is formed inwardly slightly, as indicated in the drawings, to provide clearances for the attachment of the backrest thereto.

A flange 100 formed of 7 gage steel, 1 inch wide and having two parallel side sections 101 and 102, a section 103 extending normally from the upper end 104 of the section 102 and a section 105 extending from the rearward end 106 of the section 103 to the upper end 107 of the section 101 extends normally inwardly from the inner face 92 of each of the wings 62 and 64. More particularly, the section 102 is located forwardly of hole 85 and generally parallel the forward side 81 of the wing. Section 103 extends from section 102 rearwardly across the wing immediately above hole 85. The length of section 103 (2 inches in the embodiment shown) is such that its rearward end 106 is located rearwardly of hole 85 and such that section 105 slants downwardly therefrom (in the embodiment shown at about 25°) behind hole 85. Section 103 further includes at least one threaded bore 108 (for 5/16" diameter threaded fasteners in the preferred case) extending normally therethrough, and section 105 includes a bore 109 (0.380 diameter in the preferred case) extending normally therethrough adjacent the corner formed by sections 105 and 101 of the flange 100.

The assembly of the reclining mechanism of this invention will now be described with particular reference to FIGS. 4 and 5. Starting from a pair of spaced stanchions 6*a* and 6*b* as described above, the first of two, generally rectangular glide plates 200 is mounted on posts 30 and 31. In the preferred case shown, the glide plates are generally rectangular (3.375×6.00 inches) sheets of high density polyethylene or the like material about 0.125 inches thick. Each plate 200 includes a hole 201 adjacent one corner thereof and a slot 203 extending inwardly from its opposite shorter side 204 such that the hole 201 and the slot 203 are aligned with each other. The plates 200 thus are easily mounted on the posts 30 and 31 to provide a smooth, durable and quiet travel surface for both inner and outer sides, 92 and 94, of the mounting wings.

The circumferences of the steel posts 31 and 37 are then padded, also to assure the efficient and quiet operation of the chair. Neoprene rubber tubing sections generally indicated at 205 having an inner diameter slightly smaller than the outer diameters of the posts 31 and 37 have been found to be suitable for this purpose. The tubing is stretched as it is pulled onto the posts thereby assuring a secure and tight fit therewith. Further, the material is strong enough both to withstand repeated impacts by the moving parts of the mechanism and to resist cutting by the mechanism under the forces imparted thereto by a chair occupant.

The next step of the assembly includes the location of bushings 210 (injection molded nylon, or the equivalent) in the square holes 85 of the mounting wings 62 and 64, and thereafter locating the bushings 210 on the posts 40. The bushings 210 include a first end portion 211 (which in the preferred case has an outer diameter of 1.5 inches) and an inner portion 212 (which in the preferred case is about 1.005 inches square and includes relieved portions at its corners). Sections 211 and 212 define a central bore 213 having a sidewall which extends along an inwardly curving arc as it extends from the outer wall 214 of the portion 211 to the inner wall 215 of the portion 212. The bushings 210 are slid onto the posts 40 so that the outer walls 214 of portions 211 bear respectively against the broad sides, 17*a* or 17*b*, of the adjacent upright 12. The pivotal engagement of the wings with the stanchions thus achieved is maintained by placing a washer 216 having an outer diameter greater than the dimension of the portion 212 of the bushing on the portion of the post 40 extending inwardly therefrom, and then locking the bushing and washer against the adjacent broad side 17*a* or 17*b* of the upright 12. An external retaining ring or spring clamp 34 engaging a groove 36 in the outer surface of the post 40 may conveniently be used for this purpose. Also, in the event that it is desired to further restrict the axial movement of the wing relative to the bushing, a rubber 0-ring 217 may be placed between the wing and the washer on the outer surface of portion 212.

The spring loading of the wings is accomplished by a helical compression spring 218 (contained within a protective outer boot 218*a*) mounted between the post 42 and the section 105 of the flange 100. In its relaxed state, the spring 218 has a length greater than the distance between the post 42 and the section 105 of the flange 100 when the forward side 81 of the wing is vertical. One such spring is 3 inches long, has an outer diameter of 1 inch, and inner diameter of 0.5 inches. Such a spring may be made of chrome vanadium or equivalent die spring stock. In the preferred embodiment herein disclosed, it is contemplated that such a spring will not have a load at 0.10 inch deflection greater than 54.4 lbs., or a load at 30% deflection of more than 489 lbs. A pair of spring support elements 219 and 220 are provided each including a central disk 222 and a pair of opposing posts 224 and 226 extending normally from the center of the opposite faces 228 and 230 of the disk. The posts 224 of each support element are designed to engage the inner diameter defined by the windings of the spring, and the posts 226 are sized to engage the bore 46 in the post 42 or the bore 109 extending through flange section 105.

It therefore will be seen that by holding the upper side of the wing pivotally attached to the stanchion inwardly of the stanchion, the wing may be rotated forwardly to a point whereat the distance between the flange section 105 and the post 42 exceeds the relaxed length of the spring. With the wing in that position, the posts 226 of the support elements 219 and 220 may be located in the bores 45 and 109. Thereafter, with the spring located between the support elements, the wing may be rotated rearwardly to engage the posts 224 within the respective ends of the inner diameter defined by the coils of the spring. Then, by rotating the wing still further rearwardly, the forward end 232 of slot 87 may be brought into alignment with the padded post 37. In this condition, the wing may be allowed to assume a vertical orientation with the post 37 extending through the slot 87 of the wing. Finally, the wing may be released to allow the spring to force it to pivot forwardly until post 31 engages the bearing surface 90*a* of the upper side of the wing and post 37 rests against the rear end 233 of the slot 87. Thereafter, the second of previously mentioned glide plates 200 is mounted adjacent the outer side 94 of the mounting wing in the manner discussed above.

Finally, an inner cover 234 is attached to the stanchion through the hollow posts 30, 31 and 37. This is accomplished, for example, by screws 235 extending through washers 236 and cover 234 to engage threads (not shown) located on the mating component or threaded fastener, for example, inserts 237*a* or 237*b*. The inner cover 234 will prevent accidental entrapment of clothes or body parts by the moving parts of the chair. The aisle end of a row will include an outer cover 8, placed on the outer broad side of the stanchion as indicated in FIG. 4.

As shown in FIG. 2, the flanges extending from the sides of the backrest are then attached to the wings adjacent their angled sides. The angle of this attachment to the vertical is preferably between about 15° and 21°. The seat mounting fittings are then attached to the flange sections 103 such that the axis of rotation of the seat thereon is located substantially directly above the axis of pivotal attachment of the wings to the stanchions when the seat is in its upright position (see FIG. 3). The disassembly of the reclining mechanism is the reverse of its assembly. Accordingly, it will be seen that repairs and/or replacement of broken parts may be effected simply and with minimum disturbance to adjacent chairs of the row.

The operation of the chair of this invention is also novel. As an individual sits in the chair, a vertically downward force is transmitted through the seat to the fittings, and thence to the wing and finally to the post 40. Since the individual's center of gravity, the axis upon which the seat is attached to the wings and the axis upon which the wings are attached to the stanchion are aligned substantially in the same plane when the chair is in its upright position and the individual is sitting upright, there is no tendency for the chair to shift downwardly and backwardly in response to the individual's weight. Indeed, minor variations in the alignment of these points will not cause the chair to recline until the torque applied to the wing about the post 40 caused by the individual shifting his weight backwards against the backrest exceeds the preload counter-force of the spring. Since the spring counter-force is exerted at close to ninety degrees to the direction of the applied torque, the spring counter-force is maximized. Indeed, tests of chairs made in accordance with the preferred embodiment herein described indicate that the force which must be applied to the backrest in order for the chair to achieve its optimally maximum 36° angle of recline substantially exceeds the force which would be applied by a normal individual sitting in the chair. Hence, he normal individual will not drive the chair to the stops when he reclines, and even if he does, the chair remains safe because of the strength of the engagement of the post 37 with the front edge 232 of the slot 87 in the wing. Lesser forces to achieve full recline may be provided through the use of springs 218 having a lower spring rate than those described hereinabove.

The location of the axis of the seat immediately adjacent and above the axis of attachment of the wings to the stanchions when the chair is in its upright position is additionally important because as the chair reclines the downward and backward movement of the junction between the backrest and the seat is minimized. This feature not only makes the chair easier to arise from, but also minimizes the chance of injury to an individual sitting behind the chair who has his feet extended in front of him into the space below the chair. Further, the relationship of the posts 40 and 42 with the flange section 105 is important not only because the reclining mechanism is centralized in a small area below the seat adjacent the stanchion thereby minimizing the chance of injury to those around the chair, but also because in the event that the engagement of the slot 87 with the post 37 fails for some reason and the spring becomes dislodged or breaks, the solid post 42 provides a failsafe stop mechanism which will engage the lower edge 82 of the mounting wing, to prevent the chair from flipping backward with possible injury to the occupant or an individual seated behind him.

Further modifications, adaptations, variations, adjustments and the like will occur to those skilled in the art in view of the foregoing detailed description of a preferred embodiment of the invention. It, therefore, is intended that the above description of the invention should be understood as illustrative only, and that the invention should be understood as being limited only by the terms of the claims appended hereto.

We claim:

1. A reclining chair suitable for use in theaters and the like comprising:

a pair of spaced-apart stanchions;

a backrest;

a seat; and, a pair of spaced-apart mounting wings;

each of said stanchions comprising an inner side facing the other of said stanchions and stop means projecting inwardly from said inner side;

each of said mounting wings comprising a substantially flat element having a substantially inverted, truncated, right triangular shape including an upper edge, a lower edge, a first side edge extending substantially normally between said upper and lower edges, and a second side edge extending at an angle between said upper and lower edges, and first and second stop engagement means;

one of said mounting wings being pivotally attached in spring loaded relation to a corresponding location on said inner side of each of said stanchions, said pivotal attachments being made at corresponding first points on said wings located substantially adjacent the corner formed by said lower edge and said first side edge and at a preselected distance normally from said first side edge such that each of said wings is correspondingly rotatable relative to its associated stanchion between (i) a first, normal position wherein said stop means engages said first stop engagement means and said first side edge is disposed substantially vertically, and (ii) a second, reclined position wherein said stop means engages said second stop engagement means and said first side edge is tilted at an angle to the vertical;

said backrest being supported between said second side edges of said wings; and, said seat being supported on an axis extending between corresponding second points on said wings located substantially immediately above said first points and a normal distance from said first side edges substantially equal to said preselected distance.

2. The chair of claim 1 wherein said backrest is supported between said wings at an angle x to the vertical when said wings are in said first, normal position, said backrest is tilted through an additional angle y when said wings are moved from said first, normal position to said second, reclined position, and $x+y$ is not greater than about 36°.

3. The chair of claim 1 further comprising a pair of cover members respectively affixed in spaced relation to said inner sides of one or the other of said stanchions inboard of said wings such that said wings may move relative to their associated stanchion between said first, normal position and said second, reclined position within the spaces between said cover members and said stanchions.

4. The chair of claim 1 wherein said backrest is supported between said wings when said chair is in said first, normal position at an angle between about 15° and about 21° relative to the vertical.

5. The chair of claim 1 wherein each of said stanchions comprises a vertical upright having an upper end and a horizontal projection extending outwardly and rearwardly from said upright adjacent said upper end.

6. The chair of claim 5 wherein said stanchions each define an upper surface, and wherein armrest means are secured to each of said upper surfaces.

7. The chair of claim 1 wherein said stop means of each said stanchion comprises a first post; each said wing further comprises a slot having a first end and a second end, each said slot being adapted to receive said first post of the one of said stanchions to which its associated wing is pivotally attached; and said first and second stop engagement means of each said wing respectively comprise said first and second ends of the one of said slots associated therewith.

8. The chair of claim 7 wherein each of said stanchions includes a top, wherein said stop means of each said stanchion further comprises second and third posts spaced from each other in a horizontal plane spaced from said top, and wherein said stop engagement means of each said wing further comprises a contour of said upper edge thereof, said contour defining (i) first and second bearing surfaces adapted to engage said second and third posts of its adjacent stanchion, respectively, when said wing is in its first, normal position, and (ii) adjacent surfaces adapted to allow said wing to rotate to its second, reclined position without interference.

9. The chair of claim 1 wherein each said wing includes an inner side having a flange extending normally therefrom substantially adjacent said pivotal attachment of said wing to its associated stanchion, said flange comprising a member disposed in a horizontal plane located closely below said axis upon which said seat is supported when said wings are in said first, normal position.

10. The chair of claim 9 wherein each said member includes a top surface, and wherein mounting brackets are attached to each said top surface, said mounting brackets being adapted to support said seat on said axis.

11. The chair of claim 9 wherein each of said members include a rear end located rearwardly of said first point on its associated wing, wherein said flanges further comprise a second member having a bottom surface, said second members extending rearwardly from said rear ends of said members and downwardly from said planes containing said members to far ends, and wherein spring means extend from a point on each said bottom surface to a spring support means, each said spring support means extending inwardly from an inner side of the one of said stanchions, said points on said bottom surfaces being located substantially adjacent said far ends, and said spring support means being located below and substantially adjacent said lower edge of each said wing.

12. The chair of claim 11 wherein each said spring means comprises a coil spring having two ends, and wherein said spring support means comprises at least one post.

13. The chair of claim 12 wherein said second members each define a hole adjacent said point on said bottom surface of said second member, said spring support means each includes an outer end and defines a hole substantially adjacent to said outer end, and the respective alignment of each said spring means between said point on said bottom surface of each said second member and said spring support means of the adjacent one of said stanchions is maintained by a pair of spring mounting elements, each said spring mounting element comprising a disk having a first surface defining a center, a second surface defining a center, and first and second projections extending normally from the center of said first and second surfaces respectively, said second projections of said spring mounting elements engaging the respective ends of said coil spring, said first projection of one of said spring mounting elements engaging said hole in said second member, and said first projection of the other of said spring mounting elements engaging said hole in said spring support means.

14. An array of reclining chairs suitable for use in theaters and the like comprising a plurality of rows of chairs extending between aisles, each said row including a pair of aisle end stanchions and a plurality of spaced-apart center stanchions therebetween, each said chair comprising:

a pair of spaced-apart stanchions;

a backrest;

a seat; and, a pair of spaced-apart mounting wings;

each of said stanchions comprising an inner side facing the other of said stanchions and stop means projecting inwardly from said inner side;

each of said mounting wings comprising a substantially flat element having a substantially inverted, truncated, right triangular shape including an upper edge, a lower edge, a first side edge extending substantially normally between said upper and lower edges, and a second side edge extending at an angle between said upper and lower edges, and first and second stop engagement means;

one of said mounting wings being pivotally attached in spring loaded relation to a corresponding location on said inner side of each of said stanchions, said pivotal attachments being made at corresponding first points on said wings located substantially adjacent the corner formed by said lower edge and said first side edge and at a preselected distance normally from said first side edge such that each of said wings is correspondingly rotatable relative to its associated stanchion between (i) a first, normal position wherein said stop means engages said first stop engagement means and said first side edge is disposed substantially vertically, and (ii) a second, reclined position wherein said stop means engages said second stop engagement means and said first side edge is tilted at an angle to the vertical;

said backrest being supported between said second side edges of said wings; and, said seat being supported on an axis extending between corresponding second points on said wings located substantially immediately above said fist points and a normal distance from said first side edges substantially equal to said preselected distance.

15. The array of claim 14 wherein said backrest is supported between said wings at an angle x to the vertical when said wings are in said first, normal position, said backrest is tilted through an additional angle y when said wings are moved from said first, normal position to said second, reclined position, and x+y is not greater than about 36°.

16. The array of claim 14 further comprising a pair of cover members respectively affixed in spaced relation to said inner sides of one or the other of said stanchions inboard of said wings such that said wings may move relative to their associated stanchion between said first, normal position and said second, reclined position within the spaces between said cover members and said stanchions.

17. The array of claim 14 wherein said backrest of each said chair is supported between said wings of said chair when said chair is in said first, normal position at an angle between about 15° and about 21° relative to the vertical.

18. The array of claim 14 wherein said aisle end stanchions each include an outer side, and further comprising aisle end outer covering means affixed respectively to each of said outer sides of said aisle end stanchions.

19. The array of claim 18 wherein said aisle end outer covering means include externally powered aisle illumination means.

20. The array of claim 14 wherein each of said stanchions comprises a vertical upright having an upper end and a horizontal projection extending outwardly and rearwardly from said upright adjacent said upper end.

21. The array of claim 20 wherein said stanchions each define an upper surface, and wherein armrest means are secured to each of said upper surfaces.

22. The array of claim 14 wherein said stop means of each said stanchion comprises a first post; each said wing further comprises a slot having a first end and a second end, each said slot being adapted to receive said first post of the one of said stanchions to which its associated wing is pivotally attached; and said first and second stop engagement means of each said wing respectively comprise said first and second ends of the one of said slots associated therewith.

23. The array of claim 22 wherein each of said stanchions includes a top, wherein said stop means of each said stanchion further comprises second and third posts spaced from each other in a horizontal plane spaced from said top, and wherein said stop engagement means of each said wing further comprises a contour of said upper edge thereof, said contour defining (i) first and second bearing surfaces adapted to engage said second and third posts of its adjacent stanchion, respectively, when said wing is in its first, normal position, and (ii) adjacent surfaces adapted to allow said wing to rotate to its second, reclined position without interference.

24. The array of claim 14 wherein each said wing includes an inner side having a flange extending normally therefrom substantially adjacent said pivotal attachment of said wing to its associated stanchion, said flange comprising a member disposed in a horizontal plane located closely below said axis upon which said seat is supported when said wings are in said first, normal position.

25. The array of claim 24 wherein each said member includes a top surface, and wherein mounting brackets are attached to each said top surface, said mounting brackets being adapted to support said seat on said axis.

26. The array of claim 25 wherein each of said members include a rear end located rearwardly of said first point on its associated wing, wherein said flanges further comprise a second member having a bottom surface, said second members extending rearwardly from said rear ends of said members and downwardly from said planes containing said members to far ends, and wherein spring means extend from a point on each said bottom surface to a spring support means, said spring support means extending inwardly from an inner side of the one of said stanchions, said points on said bottom surfaces being located substantially adjacent said far ends, and said spring support means being located below and substantially adjacent said lower edge of each said wing.

27. The array of claim 26 wherein each said spring means comprises a coil spring having two ends, and wherein said spring support means comprises at least one post.

28. The array of claim 27 wherein said second members each define a hole adjacent said point on said bottom surface of said second members, said spring support means each includes an outer end and defines a hole substantially adjacent to said outer end, and the respective alignment of each said spring means between said point on said bottom surface of each said second member and said spring support means of the adjacent one of said stanchions is maintained by a pair of spring mounting elements, each said spring mounting element comprising a disk having a first surface defining a center, a second surface defining a center, and first and second projections extending normally from the center of said first and second surfaces respectively, said second projections of said spring mounting elements engaging the respective ends of said coil spring, said first projection of one of said spring mounting elements engaging said hole in said second member, and said first projection of the other of said spring mounting elements engaging said hole in said spring support means.

* * * * *